US009472361B1

(12) United States Patent
Mikan

(10) Patent No.: US 9,472,361 B1
(45) Date of Patent: Oct. 18, 2016

(54) CIRCUIT BOARD CONTACTS USED TO IMPLEMENT SWITCH CONTACTS OF KEYPADS AND KEYBOARDS

(71) Applicant: ES BETA, INC., Weymouth, MA (US)

(72) Inventor: Peter J. Mikan, Monroe, CT (US)

(73) Assignee: ES Beta, Inc., Weymouth, MA (US)

( * ) Notice: Subject to any disclaimer, the term of this patent is extended or adjusted under 35 U.S.C. 154(b) by 0 days.

(21) Appl. No.: 14/508,547

(22) Filed: Oct. 7, 2014

(51) Int. Cl.

| | |
|---|---|
| ***H01H 1/02*** | (2006.01) |
| ***H01H 13/785*** | (2006.01) |
| ***H01H 13/79*** | (2006.01) |
| ***H01H 13/704*** | (2006.01) |
| ***H01H 13/10*** | (2006.01) |

(52) U.S. Cl.
CPC ..... *H01H 13/785* (2013.01); *H01H 13/10* (2013.01); *H01H 13/704* (2013.01); *H01H 13/79* (2013.01); *H01H 2201/024* (2013.01); *H01H 2201/026* (2013.01); *H01H 2203/058* (2013.01); *H01H 2227/018* (2013.01)

(58) Field of Classification Search
CPC .... H01R 13/03; H01H 13/785; H01H 13/10; H01H 13/704; H01H 13/79
USPC ..... 200/269, 262, 266, 263–265, 267–268, 200/181
See application file for complete search history.

(56) References Cited

U.S. PATENT DOCUMENTS

| | | | | |
|---|---|---|---|---|
| 4,339,644 A * | 7/1982 | Aldinger | H01H 1/023 | 200/266 |
| 5,860,513 A * | 1/1999 | Suzuki | C23C 28/021 | 200/268 |
| 7,015,406 B2 * | 3/2006 | Ganz | H01R 13/03 | 200/262 |
| 7,215,229 B2 * | 5/2007 | Shen | H01H 50/005 | 200/181 |

* cited by examiner

*Primary Examiner* — Edwin A. Leon
(74) *Attorney, Agent, or Firm* — Clark & Brody

(57) ABSTRACT

An improved printed circuit board contacts that are used to implement switch contacts of keypads and keyboards combining gold and silver plating over copper conductors. In the preferred embodiment of FIG. 5 shows a cross section of the printed circuit board 14 and the switch contact 20, where the switch contact material is electrolysis immersion silver layer 26 plated onto copper layer 22 and an electrolysis immersion gold layer 28 plated over that. An alternate embodiment is shown in FIG. 4 of a printed circuit board 14 with a switch contact 20, wherein a layer of nickel 24 is plated over the copper layer 22, then the silver layer 26 is plated onto the nickel 24, then the gold layer 28 is the topmost layer. Here the nickel layer is used to prevent copper migration into the other layers.

6 Claims, 5 Drawing Sheets

CIRCUIT BOARD CONTACTS USED TO IMPLEMENT SWITCH CONTACTS OF KEYPADS AND KEYBOARDS

RELATED DOCUMENT

This application is substantially the same as provisional application Ser. No. 61/887,836 filed Oct. 7, 2013 by the same inventor-applicant bearing the same title "Improved Circuit Board Contacts Used to Implement Switch Contacts of Keyboards and Keypads" and the applicant hereby claims priority there from.

THE PROBLEM

The problem with prior art Improved Circuit Board Contacts Used to Implement Switch Contacts of Keyboards and Keypads is that they are not reliable. This invention solves this problem with 4 layer contact switch as well as replacing gold with silver which is cheaper and better conductor of heat and electricity.

PRIOR ART

A formal preliminary prior art patentability and novelty search was neither conducted nor commissioned, but the inventor at the cutting edge of this technology is intimately familiar with the prior art. No prior art exists to match the functionality ergonomics and user friendliness of the present invention. Accordingly none of the prior art devices singly or even in combination provides all of the features and objectives established by the inventor for this system as enumerated below.

OBJECTIVES

The main objective and benefit of the invention is that it makes possible high reliability switch contacts on a printed circuit board using primarily silver, in place of electrolytic gold, while simultaneously overcoming the difficulty of soldering components to the silver plated component pads of said printed circuit board, by having a thin layer, approximately three micro-inches, of gold plating over the silver. This electrolysis immersion process gold layer prevents the silver solder pads from oxidizing.

Other objectives, elegance of design, ease of manufacture, service and use and even aesthetics as will become apparent from the following brief description of the drawings and the detailed description of the concept embodiment.

DETAILED DESCRIPTION OF THE BEST MODE PREFERRED EMBODIMENT

Figure 1:
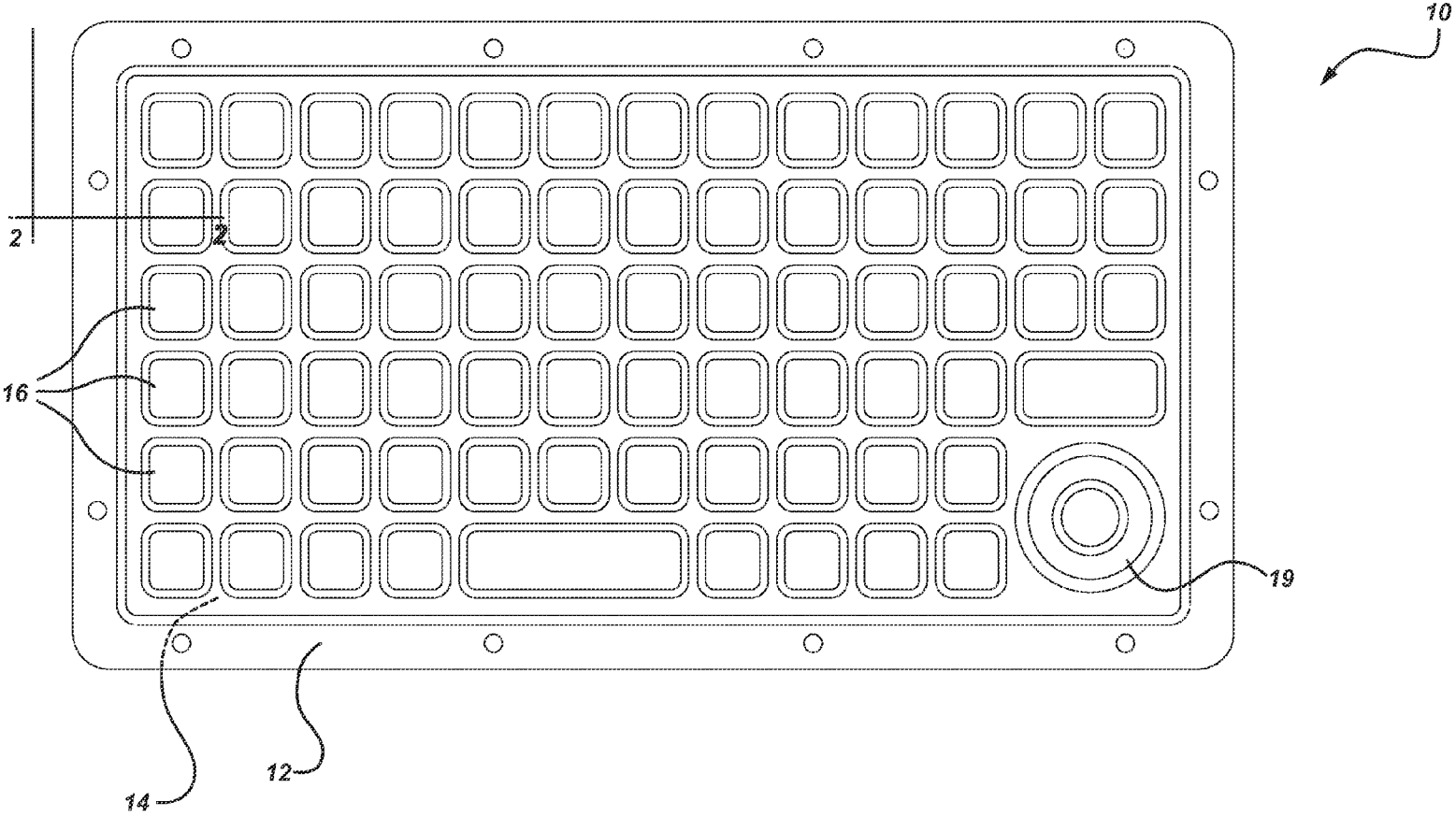
FIG. 1 shows a top view of a typical elastomer keyboard with multiple switches and an embedded button-style cursor pointer.
Figure 2:
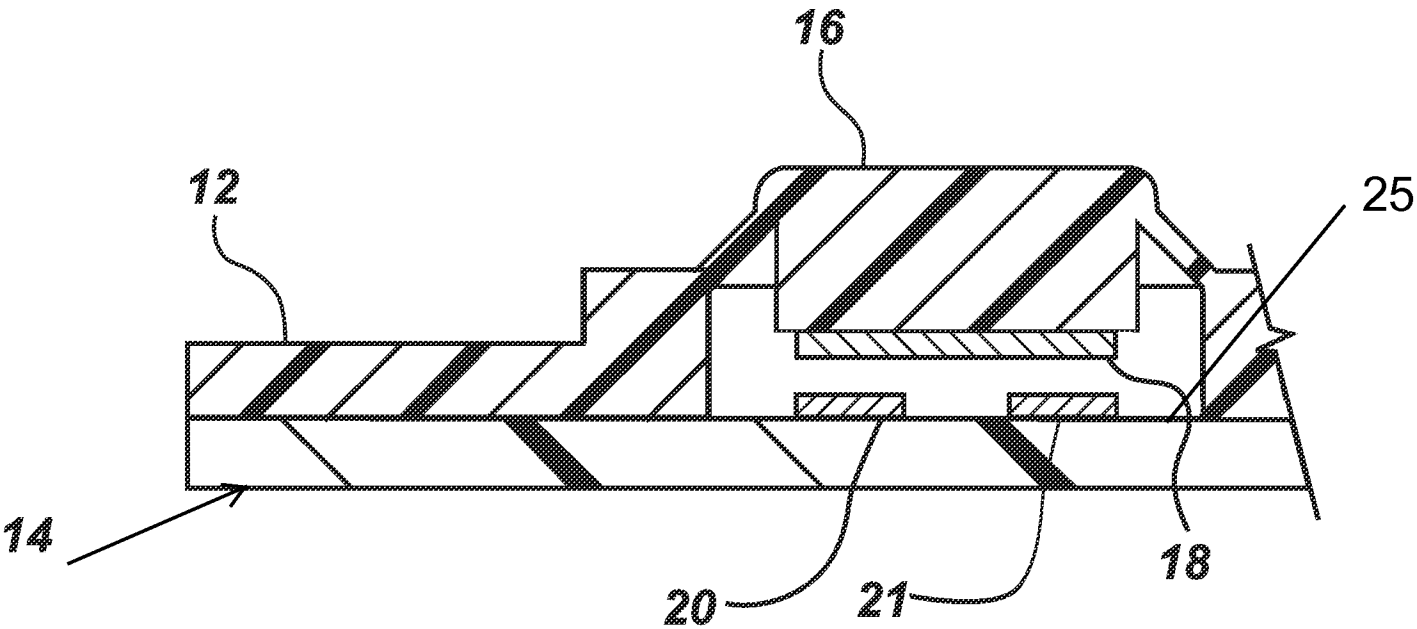
FIG. 2 Shows a partial cross section along lines 2-2 of FIG. 1
Figure 3:
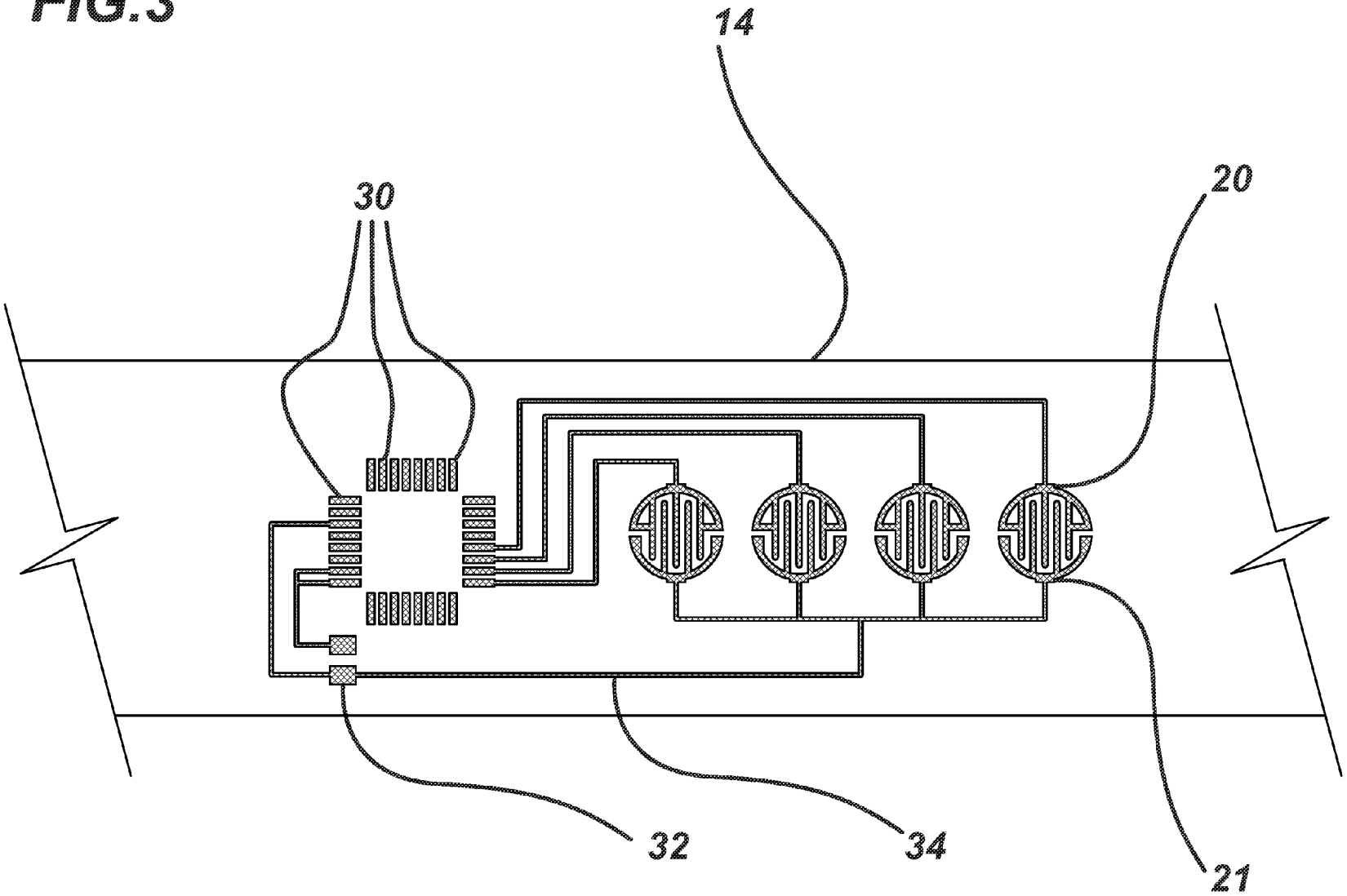
FIG. 3 shows a partial top view of a printed circuit board (PCB) that is used with the keyboard of FIG. 1.

The present invention describes a keyboard or keypad 10 of FIG. 1 consisting of a molded elastomer 12 with raised keys 16, the underside of which, shown in FIG. 2 have a conductive contact 18 integrated thereto which forms the moving conductor of a switch. The stationary portion of the switch contacts 20 and 21 are on the surface of the printed circuit board 14. FIG. 3 shows additional solder pads 30, used typically for integrated circuits, and 32 used typically for discreet electronic components are also on the surface of the printed circuit board, as are electrical connections 34.

Figure 5:
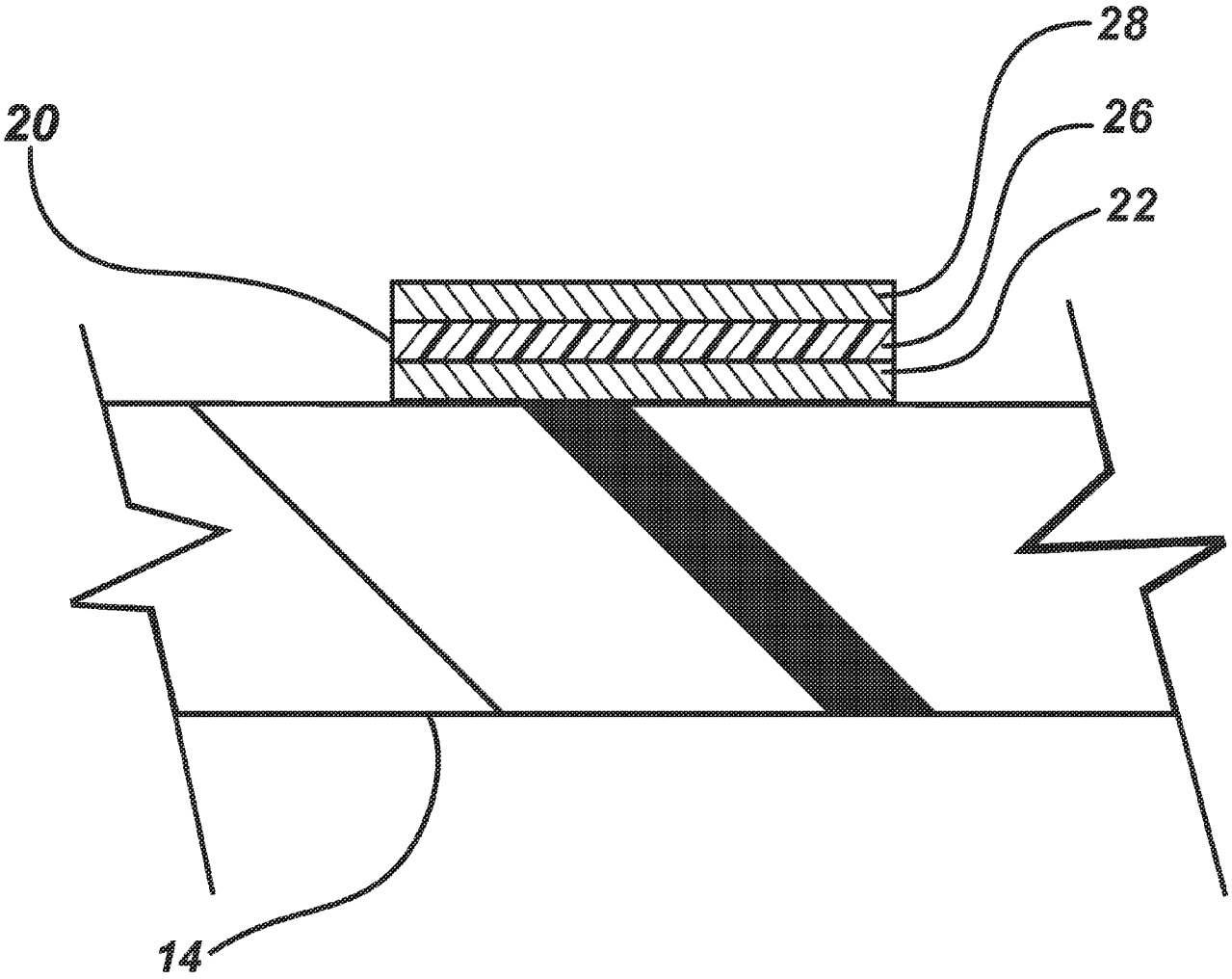
FIG. 5 shows a cross section of an alternate metal contact of the PCB in FIG. 3

In the preferred embodiment of FIG. 5 shows a cross section of the printed circuit board 14 and the switch contact 20, where the switch contact material is electroless immersion silver layer 26 plated onto copper layer 22 and an electrolysis immersion gold layer 28 plated over that. Typically, the gold layer 28 is thinner but as it wears, it will expose the thicker silver layer 26 which is the actual switch contact. In other areas of the printed circuit board as shown in FIG. 3, all copper conductors are also plated as is contact 20 of FIG. 5. This provides a thin layer of gold to protect the component solder pad areas 30 and 32 of FIG. 3 from oxidizing so that any required components such as resistors, capacitors and integrated circuits can be soldered to their respective pads.

Figure 4:
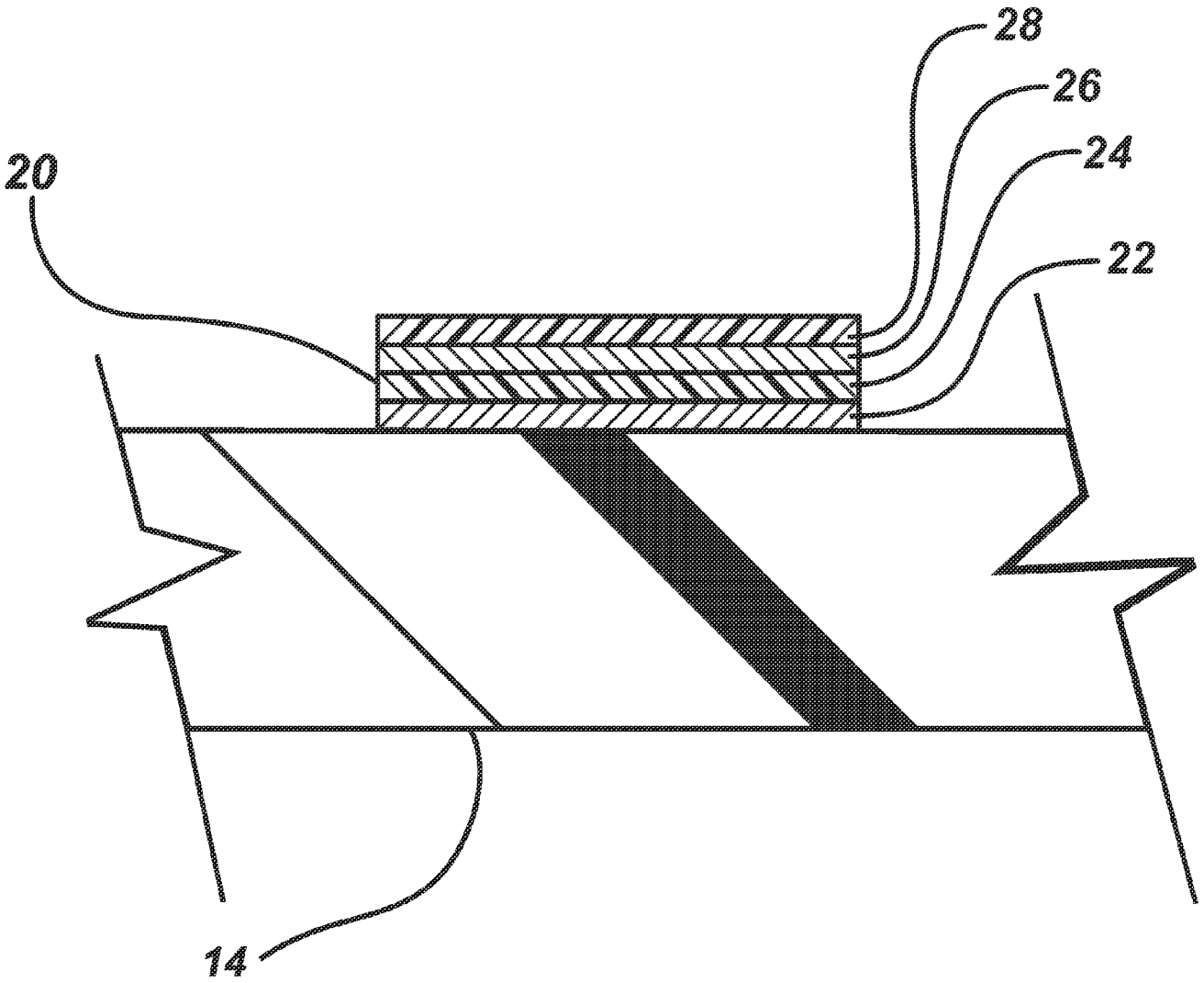
FIG. 4 shows a cross section of a typical metal contact of the PCB in FIG. 3

An alternate embodiment is shown in FIG. 4 of a printed circuit board 14 with a switch contact 20, wherein a layer of nickel 24 is plated over the copper layer 22, then the silver layer 26 is plated onto the nickel 24, then the gold layer 28 is the topmost layer. Here the nickel layer is used to prevent copper migration into the other layers.

In order to appreciate the novelty of the improvement in this invention, the following background of the prior art practice would focus on the improvement.

Background & Novelty

Keypad and keyboards implemented with conductive metal contacts plated onto printed circuit boards (PCBs) are well known in the art. In addition, key actuators made of elastomer with conductive pads attached thereto, that when pressed; electrically connect two aforementioned PCB contacts are also well known in the art. FIG. 1 shows a typical keyboard 10, comprised of molded elastomeric rubber 12, and having variously disposed keys 16, as well as, a button style pointer 19. FIG. 2 shows a cross-section 2-2 of a typical key of the keyboard, where metal contacts 20 and 21 are shown attached to the printed circuit 14, and a conductive pad 18 is shown attached to the underside of the key 16 which is part of the molded elastomer 12.

There are many processes and materials that can be used in place of the metal contacts, such as, conductive inks and conductive polymers, additionally the printed circuit board can be fabricated with various rigid material, and in place of the elastomer, other materials such as polymers, or mechanical components can be used. The aforementioned substitutions are well known in the art.

For keypads and keyboards that require higher reliability and longer life, the typical configuration involves a traditional rigid printed circuit with copper conductors that are plated with gold to form switch contacts. These conductors might be in a pattern as shown in FIG. 3 of the printed circuit board 14, where the switch contacts are comprised of two conductive elements 20 and 21. The other conductors might be traces for circuit elements such as a conductor 34 which is shown connecting the common side of the four switch contacts shown that are labeled 21. Also, on some printed circuit boards, in addition to switch contacts, there are also solder pads for components as well as other electrical connections, which in FIG. 3 are solder pads 32 for a typical electronic component, such as a resistor or capacitor, and solder pads 30 which could be for an integrated circuit such as a microprocessor.

There are well known processes for plating gold onto printed circuit board conductors. One is an electroplating chemical process based on Faraday's discovery which states that a given amount of material is deposited at an electrode by a given amount of electricity. Thus this method, which refers to electrolytic gold plating, can accurately control the thickness of the gold plating and is well suited for gold contacts, but it requires that an electrical connection which is used only for plating purposes be made to every part to be plated, this adds cost and complexity to the printed circuit board.

Another well-known process for plating gold onto printed circuit board conductors is an immersion process that does not need any electrical connections but instead uses a solution, typically an acid bath, containing the material to be deposited and relies on time, temperature, agitation and concentrations of materials and solutions to control the plating thickness. This is a lower cost process and does not require electrical connections to the surfaces to be plated, but it has several disadvantages. One of which is that all exposed surfaces are plated and the other is that it is limited in both controlling the thickness of the plating, as well as, the absolute plating thickness attainable. For these reasons, immersion gold plating is better suited for plating onto copper for the purpose of soldering components to the printed circuit board, such as for pads 30 and 32 of FIG. 3, rather than for switch contacts. In addition, immersion plating is not as durable as electrolytic plating, which is another reason it is not recommended for switch contacts that need to be long lasting and reliable.

Both electrolytic and electroless immersion gold plating are relatively expensive, but electrolytic gold is more costly in particular if a thicker switch contact is required. For these reasons the alternate element that can be used as a switch contact material, by plating onto a copper conductor on PCBs is silver and this is also well known in the art. These three metals, copper, silver and gold are the three metals in group IB of the periodic table of the elements, where the periodic table refers to the ordering of elements in a table by Mendeleev based on the concept that the properties of the elements are functions of their atomic numbers. These three metals are very ductile and malleable, and are also excellent conductors of heat and electricity. An additional metal, nickel, which has an atomic number of 28 and therefore is adjacent to copper in the periodic table of the elements, as copper has an atomic number of 29, can also be used in the plating process of printed circuit boards. Nickel is typically used as a barrier between copper and gold to prevent copper migration to the other layers and this is also well known in the art.

Additionally, of the three metals, copper, silver and gold commonly used for high reliability circuits and switch contacts on printed circuit boards, copper and silver when exposed to air form oxides, which oxides are still conductive but cannot be readily soldered to. In contrast to copper and silver, gold does not oxidize and this is well known in the art.

Definitions and Acronyms

A great care has been taken to use words with their conventional dictionary definitions. Following definitions are included here for clarification.

3D=Three Dimensional

DIY=Do It Yourself

I/O=Input and Output

Integrated=Combination of two entities to act like one

Interface=Junction between two dissimilar entities

Keypad=A data entry device from an operator(s) to computer(s)

PCB=Printed Circuit Board

SPST=Keypad and Keyboard Key as Switches as SPST (Single pole single throw) 28×3=84 Total Proportional=Ideal ratio under the design rules and circumstances.

Symmetrical=The shape of an object of integrated entity which can be divided into two along some axis through the object or the integrated entity such that the two halves form mirror image of each other.

REFERENCE NUMERAL CONCORDANCE (IN ASCENDING ORDER)

10=typical keypad/keyboard assembly
12=molded elastomer forming the array of keys of the keypad
14=rigid printed circuit
16=individual raised keys of the molded elastomer keypad
19=optional button style pointer of the molded elastomer keypad
18=conductive contact integrated into the underside of an individual key
20=one-half of a metal contact of a switch formed on the surface of the printed circuit board
21=second-half of a metal contact of a switch formed on the surface of the printed circuit board
22=the bottom, copper layer of a typical switch contact
24=the optional second, nickel layer of a typical switch contact
26=the third, silver layer of a typical switch contact
28=the top, gold layer of a typical switch contact
30=solder pad areas of the printed circuit board for connecting a typical electronic integrated circuit thereon
32=solder pad areas of the printed circuit board for connecting a typical discreet electronic component thereon
34=conductive path on the printed circuit forming the electrical connections of said circuit

Design Around Variations & Alternate Embodiments

1. The value and the tolerance of various electronic components may be modified.
2. The order of the process steps may be varied.
3. The keyboard and keypad keys may be built with prior art enhancements, such as membrane technology or with molded plastic keycaps or with alternate materials.
4. The PCB and its conductors can be made of different materials as they become available due to the technological progress in polymer chemistry
5. Additional complimentary and complementary functions and features may be added.

Other changes such as aesthetics and substitution of newer materials as they become available, which substantially perform the same function in substantially the same manner with substantially the same result without deviating from the spirit of the invention may be made.

While this invention has been described with reference to illustrative embodiments, this description is not intended to be construed in a limiting sense. Various modifications and combinations of the illustrative embodiments as well as other embodiments of the invention will be apparent to a person of average skill in the art upon reference to this description. It is therefore contemplated that the appended claim(s) cover any such modifications, embodiments as fall within the true scope of this invention.

The invention claimed is:

1. A printed circuit board comprising:

a) a circuit board substrate, b) switch contacts, component solder pads and connecting conductive circuits formed in copper layer, wherein at least one of said switch contacts is electrically connected to at least one of said component solder pads and at least one of said component solder pads is electrically connected to at least one other said component solder pads, c) a layer of immersion silver plating over the copper layer, which silver layer forms that actual switch contact material, d) a layer of immersion gold plating over the silver layer, which gold layer protects the component solder pads from oxidizing.

2. A printed circuit board comprising:

a) a circuit board substrate, b) switch contacts, component solder pads and connecting conductive circuits formed in copper layer, wherein at least one of said switch contacts is electrically connected to at least one of said component solder pads and at least one of said component solder pads is electrically connected to at least one other said component solder pads, c) a layer of immersion nickel plating over the copper layer, d) a layer of immersion silver plating over the nickel layer, which silver layer forms the actual switch contact material, e) a layer of immersion gold plating over the silver layer, which gold layer protects the component solder pads from oxidizing.

3. A printed circuit board comprising:

a circuit board substrate;

a first metallic layer disposed over said circuit board substrate, said first metallic layer comprising: a plurality of switch contacts; and a plurality of component solder pads, wherein at least one of said plurality of switch contacts is electrically connected to at least one of said plurality of component solder pads and at least one of said plurality of component solder pads is electrically connected to at least one other plurality of component solder pads;

a second metallic layer disposed over said first metallic layer; and a third metallic layer disposed over said second metallic layer wherein said third metallic layer corresponding to said plurality of switch contacts is temporary and said third metallic layer corresponding to said competent solder pads is permanent.

4. The printed circuit board of claim 3 wherein said first metallic layer comprises copper.

5. The printed circuit board of claim 3 wherein said second metallic layer comprises silver.

6. The printed circuit board of claim 3 wherein said third metallic layer comprises gold.

* * * * *